US011375584B2

(12) United States Patent
Koh et al.

(10) Patent No.: US 11,375,584 B2
(45) Date of Patent: Jun. 28, 2022

(54) METHODS AND APPARATUS FOR PROCESSING A SUBSTRATE USING MICROWAVE ENERGY

(71) Applicant: APPLIED MATERIALS, INC., Santa Clara, CA (US)

(72) Inventors: Tuck Foong Koh, Singapore (SG); Yueh Sheng Ow, Singapore (SG); Nuno Yen-Chu Chen, Singapore (SG); Ananthkrishna Jupudi, Singapore (SG); Preetham P. Rao, Sunnyvale, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 370 days.

(21) Appl. No.: 16/545,901

(22) Filed: Aug. 20, 2019

(65) Prior Publication Data

US 2021/0059017 A1 Feb. 25, 2021

(51) Int. Cl.
*H05B 1/02* (2006.01)
*H05B 6/80* (2006.01)

(52) U.S. Cl.
CPC ..... *H05B 1/0233* (2013.01); *H05B 6/80* (2013.01)

(58) Field of Classification Search
CPC ..... H05B 1/0233; H05B 6/80; H05B 6/806
USPC ..... 219/702
See application file for complete search history.

(56) References Cited

U.S. PATENT DOCUMENTS 5,159,838 A 11/1992 Lynnworth
9,306,263 B2 4/2016 Herbsommer et al.
2009/0321432 A1* 12/2009 Han ..... H05B 6/6408 219/761
2011/0233198 A1* 9/2011 Okuno ..... H05B 6/806 219/651
2014/0073065 A1* 3/2014 Ohno ..... H01L 21/67248 438/5
2015/0235878 A1* 8/2015 Suguro ..... H01L 21/324 438/795
2020/0152490 A1 5/2020 Yanagisawa

FOREIGN PATENT DOCUMENTS

JP 2006147782 A 6/2006

OTHER PUBLICATIONS

International Search Report for PCT/US2020/031265, dated Aug. 28, 2020.

* cited by examiner

*Primary Examiner* — Ibrahime A Abraham
*Assistant Examiner* — Frederick F Calvetti
(74) *Attorney, Agent, or Firm* — Moser Taboada

(57) ABSTRACT

Methods and apparatus for processing a substrate are provided herein. The apparatus can include, for example, a microwave energy source configured to provide microwave energy from beneath a substrate support provided in an inner volume of the process chamber; a first microwave reflector positioned on the substrate support above a substrate supporting position of the substrate support; and a second microwave reflector positioned on the substrate support beneath the substrate supporting position, wherein the first microwave reflector and the second microwave reflector are positioned and configured such that microwave energy passes through the second microwave reflector and some of the microwave energy is reflected from a bottom surface of the first microwave reflector back to the substrate during operation.

20 Claims, 3 Drawing Sheets

METHODS AND APPARATUS FOR PROCESSING A SUBSTRATE USING MICROWAVE ENERGY

FIELD

Embodiments of the present disclosure generally relate to methods and apparatus for processing a substrate, and more particularly, to methods and apparatus for processing a substrate using a process chamber configured for bottom launch delivery of microwave energy.

BACKGROUND

In recent years new advanced packaging integration schemes for various types of substrates have been used. The substrates, for example, can be made from any suitable material and can sometimes be coated with one or more metal thin films (e.g., titanium (or other metal) coated glass substrates, titanium (or other metal) coated silicon substrates, epoxy substrates with embedded silicon dies, etc.). When packaging such substrates, microwave energy, which can be provided by one or more microwave energy sources through a sidewall (e.g., side launch) of the process chamber, is used to heat the substrates. Unfortunately, when processing substrates with such chambers, due to the behavior of the substrates (e.g., which can act as a conductor) in an E-field and B-field of the microwave energy, uniform heating of the substrates is sometimes hard to achieve. For example, the edges (e.g., peripheral edges) of the substrates tend to heat up quicker (and/or to higher temperatures) than the remaining area of the substrates, sometimes referred to as "edge hot" phenomenon. To overcome non-uniform heating of the substrates during operation, conventional process chambers can employ one or more various techniques. For example, some process chambers can be configured to rotate a hoop of the process chamber for rotating the substrate. Alternatively or additionally, some process chambers can include a microwave stirrer for agitating microwaves, e.g., to create additional microwave modes, and/or can be configured to sweep through different microwave frequencies. Such techniques, however, can be unpredictable and/or uncontrollable, and, typically, do not provide adequate uniform heating of the substrate.

Accordingly, the inventors have found that there is a need for methods and apparatus for processing a substrate using a process chamber configured for bottom launch delivery of microwave energy and including hardware configured to more evenly distribute microwave energy across the substrate.

SUMMARY

Methods and apparatus for processing a substrate are provided herein. In some embodiments, for example, a process chamber for processing a substrate includes a microwave energy source configured to provide microwave energy from beneath a substrate support provided in an inner volume of the process chamber; a first microwave reflector positioned on the substrate support above a substrate supporting position of the substrate support; and a second microwave reflector positioned on the substrate support beneath the substrate supporting position, wherein the first microwave reflector and the second microwave reflector are positioned and configured such that microwave energy passes through the second microwave reflector and some of the microwave energy is reflected from a bottom surface of the first microwave reflector back to the substrate during operation.

In accordance with at least some embodiments, a process chamber for processing a substrate includes a substrate support provided in an inner volume of the process chamber; a first microwave reflector positioned on the substrate support above a substrate supporting position of the substrate support; a second microwave reflector positioned on the substrate support beneath the substrate supporting position; and a third microwave reflector positioned on the substrate support above the second microwave reflector and beneath the substrate supporting position, wherein the microwave energy passes through the second microwave reflector and some of the microwave energy passes through the third microwave reflector such that some of the microwave energy is reflected from a bottom surface of the first microwave reflector back to the substrate during operation.

In accordance with at least some embodiments, a method for processing a substrate using a process chamber can include positioning, on a substrate support disposed in an inner volume of a process chamber, a first microwave reflector above a substrate; positioning, on the substrate support, a second microwave reflector beneath the substrate; and transmitting, from beneath the substrate, microwave energy from a microwave energy source of the process chamber such that the microwave energy passes through the second microwave reflector and some of the microwave energy is reflected from a bottom surface of the first microwave reflector back to the substrate.

Other and further embodiments of the present disclosure are described below.

BRIEF DESCRIPTION OF THE DRAWINGS

Embodiments of the present disclosure, briefly summarized above and discussed in greater detail below, can be understood by reference to the illustrative embodiments of the disclosure depicted in the appended drawings. However, the appended drawings illustrate only typical embodiments of the disclosure and are therefore not to be considered limiting of scope, for the disclosure may admit to other equally effective embodiments.

Figure 1:
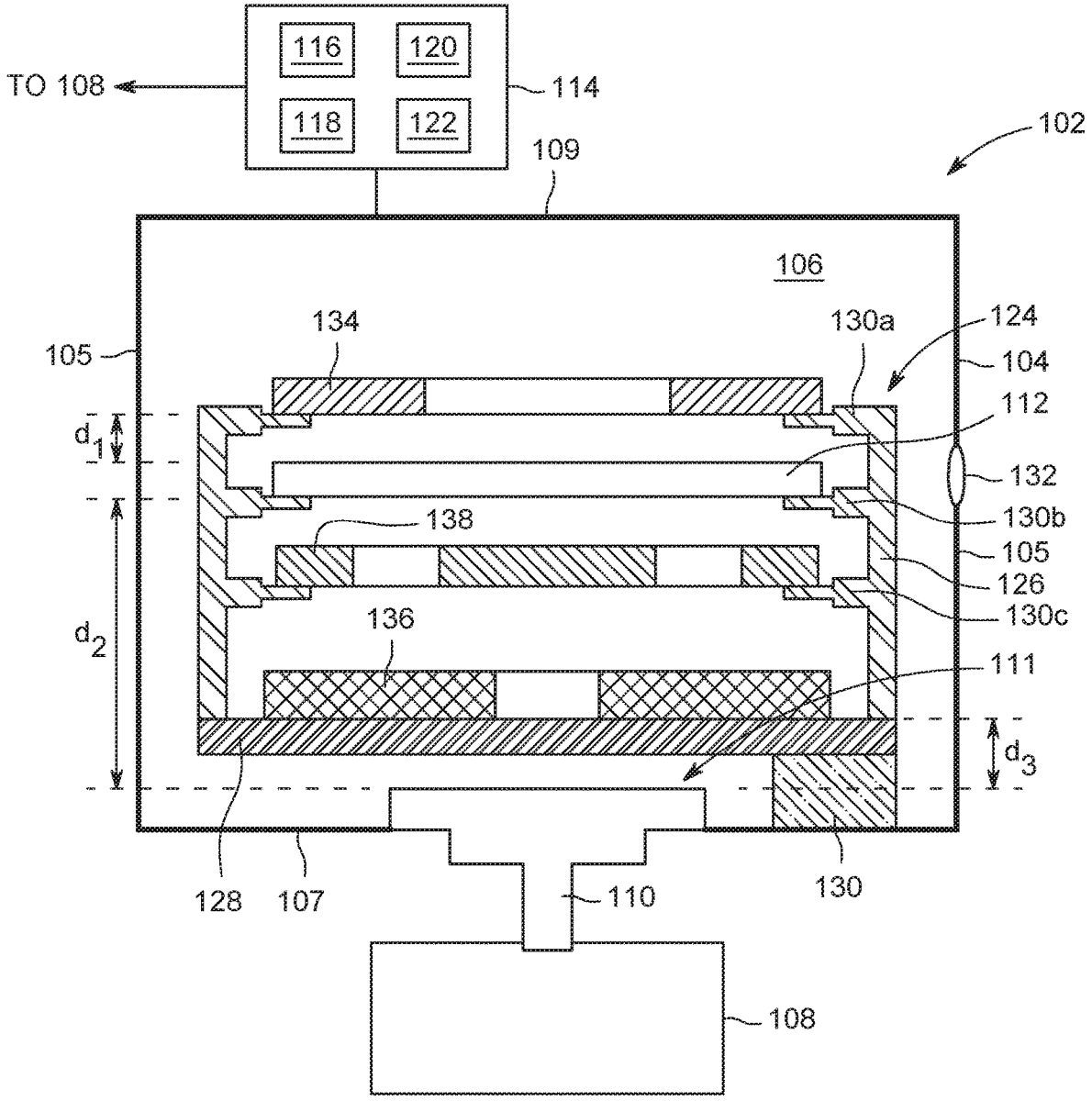
FIG. 1 is a schematic side view of a process chamber in accordance with at least some embodiments of the present disclosure.

To facilitate understanding, identical reference numerals have been used, where possible, to designate identical elements that are common to the figures. The figures are not drawn to scale and may be simplified for clarity. Elements and features of one embodiment may be beneficially incorporated in other embodiments without further recitation.

DETAILED DESCRIPTION

Embodiments of methods and apparatus for processing a substrate using a process chamber configured for bottom launch delivery of microwave energy and including hardware configured to evenly distribute microwave energy across the substrate are provided herein. The hardware can include, for example, two annular microwave reflectors and an optional additional microwave reflector. A substrate can be positioned between the two annular microwave reflectors to process the substrate and microwave energy can be directed from a bottom (e.g., from beneath the substrate) of the process chamber through a bottom one of the microwave reflectors to process the substrate. Some of the microwave energy is reflected from a bottom surface of a top one of the microwave reflectors and back towards the substrate to provide uniform heating of the substrate and reduce, if not eliminate, edge hot phenomenon typically associated with conventional process chambers.

FIG. 1 is a schematic side view of a process chamber 102 in accordance with at least some embodiments of the present disclosure. The process chamber 102 includes a chamber body 104 defined by sidewalls 105, a bottom surface (or portion) 107, and a top surface (or portion) 109. The chamber body 104 encloses an inner (or processing) volume 106 (e.g., made from one or more metals suitable for use with processing substrates, such as aluminum, steel, etc.) in which one or more types of substrates can be disposed for processing. In at least some embodiments, when a substrate is being processed, the inner volume 106 can be configured to provide a vacuum environment, e.g., to eliminate/reduce thermal cooling dynamics while the substrate is being heated.

In some embodiments, the process chamber 102 can be configured for packaging substrates. In such embodiments, the process chamber 102 can include one or more microwave energy sources 108 configured to provide microwave energy to the inner volume 106 via, for example, waveguide 110, for heating the substrate, e.g., from about 130° C. to about 150° C. The temperature that the substrate can be heated to can depend on, for example, thermal budget considerations, industry practices, etc. Accordingly, in some embodiments, the substrate can be heated to temperatures less than 130° C. and greater than 150° C. One or more temperature sensors (not shown), e.g., non-contact temperature sensors, such as infrared sensors, can be used to monitor a temperature of the substrate while the substrate is being processed, e.g., in-situ.

The waveguide 110 can be configured to provide the microwave energy through the bottom surface 107 (bottom launch) of the chamber body 104 (e.g., from beneath the substrate for centrosymmetric propagation of microwaves). More particularly, a waveguide opening 111 through which microwave energy is launched or output is provided at the bottom surface 107 of the chamber body 104. The waveguide opening 111 can be flush with the bottom surface 107 or can be slightly raised above the bottom surface 107, as illustrated in FIG. 1. In at least some embodiments, the microwave energy source 108 can be configured to sweep through one or more frequencies. For example, the microwave energy source 108 can be configured to sweep through frequencies from about 5.85 GHz to about 6.65 GHz.

A substrate 112 that is processed in the process chamber 102 can be any suitable substrate, e.g., silicon, germanium, glass, epoxy, etc. For example, in some embodiments, the substrate 112 can be made from glass having at least one metal (e.g., titanium, tungsten, etc.) deposited thereon, silicon having at least one metal (e.g., titanium, tungsten, etc.) deposited thereon, or an epoxy substrate (wafer) with one or more embedded silicon dies.

A controller 114 is provided and coupled to various components of the process chamber 102 to control the operation of the process chamber 102 for processing the substrate 112. The controller 114 includes a central processing unit (CPU) 116, support circuits 118 and a memory or non-transitory computer readable storage medium 120. The controller 114 is operably coupled to and controls the microwave energy source 108 directly, or via computers (or controllers) associated with a particular process chamber and/or support system components. Additionally, the controller 114 is configured to receive an input from, for example, the temperature sensor for controlling the microwave energy source 108 such that a temperature of the substrate 112 does not exceed a threshold while the substrate 112 is being processed.

The controller 114 may be any form of general-purpose computer processor that can be used in an industrial setting for controlling various chambers and sub-processors. The memory, or non-transitory computer readable storage medium, 120 of the controller 114 may be one or more of readily available memory such as random access memory (RAM), read only memory (ROM), floppy disk, hard disk, optical storage media (e.g., compact disc or digital video disc), flash drive, or any other form of digital storage, local or remote. The support circuits 118 are coupled to the CPU 116 for supporting the CPU 116 in a conventional manner. The support circuits 118 include cache, power supplies, clock circuits, input/output circuitry and subsystems, and the like. Inventive methods as described herein, such as the method for processing a substrate (e.g., substrate packaging), may be stored in the memory 120 as software routine 122 that may be executed or invoked to control the operation of the microwave energy source 108 in the manner described herein. The software routine may also be stored and/or executed by a second CPU (not shown) that is remotely located from the hardware being controlled by the CPU 116.

Continuing with reference to FIG. 1, a substrate support 124 is configured to support at least one substrate (e.g., the substrate 112) in at least one substrate supporting position and one or more hardware components, e.g., microwave reflectors, which are used to assist in processing the substrate 112, in a vertically spaced apart configuration. In at least some embodiments, the substrate 112 can be one of a plurality of substrates (e.g., a batch of substrates) supported by the substrate support 124. The substrate support 124 includes one or more vertical supports 126. The vertical supports 126 further include a plurality of peripheral members (e.g., peripheral members 130*a*, 130*b*, and 130*c*) extending radially inward from the vertical supports 126. The peripheral members 130*a*-130*c* (e.g., peripheral member 130*b*) are configured to support the substrate 112 (or substrates) in the substrate supporting position and the one or more hardware components, e.g., a first microwave reflector 134 and an optional a third microwave reflector 138.

In at least some embodiments, the substrate support 124 can include a lift assembly (not shown). The lift assembly may include one or more of a motor, an actuator, indexer, or the like, to control the vertical position of the peripheral members 130*a*-130*c*. The vertical position of the peripheral members 130*a*-130*c* is controlled for placing and removing the substrate 112 through an opening 132 (e.g., a slit valve opening) and onto or off one or more of the peripheral members 130*a*-130*c*. The opening 132 is formed through one of the sidewalls 105 at a height proximate the peripheral members 130*a*-130*c* to facilitate the ingress and egress of the substrate 112 into the inner volume 106. In some embodiments, the opening 132 may be retractably sealable, for example, to control the pressure and temperature conditions of the inner volume 106.

The vertical supports 126 can be supported by one or more components within the inner volume 106 of the process chamber 102. For example, in at least some embodiments, the vertical supports 126 may be supported by a hoop 128. The hoop 128 can be supported on the bottom surface 107 of the chamber body 104, for example via one more coupling elements such as fastening screws or the like, adjacent the waveguide opening 111 disposed through the waveguide 110. Alternatively or additionally, the hoop 128 can be supported on a bellows 130 that can be disposed on the bottom surface 107, as shown in FIG. 1. The bellows 130 is configured to provide vacuum sealing between the inner volume 106 and the lift assembly (e.g. when the substrate support 124 is moved up and down). The hoop 128 is also configured to support a hardware component which is used to process the substrate 112, e.g., a second microwave reflector 136. The hoop 128 can be made from a suitable material capable of supporting the above-mentioned components including, but not limited to metal, metal alloy, etc. For example, in at least some embodiments, the hoop 128 can be made from stainless steel.

Figure 2A:
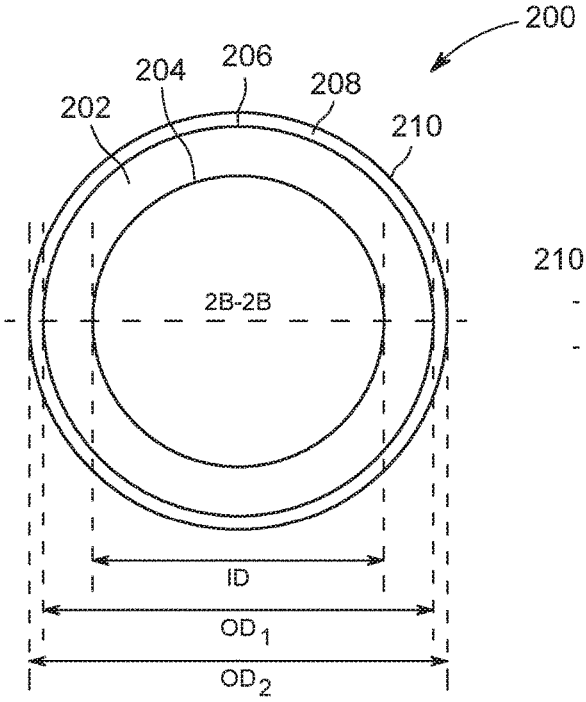
FIG. 2A is a schematic top view of a hardware component of the process chamber in accordance with at least some embodiments of the present disclosure.
Figure 2B:
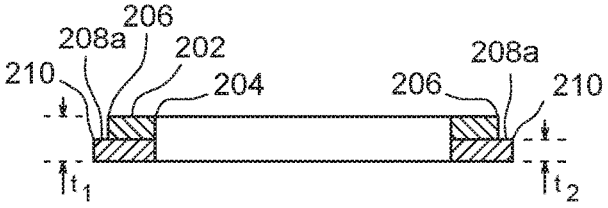
FIG. 2B is a cross-sectional side view taken along line segment 2B-2B of FIG. 2A.

FIG. 2A is a schematic top view of a microwave reflector 200 (reflector 200) of the process chamber in accordance with at least some embodiments of the present disclosure. The reflector 200 can be used as the first microwave reflector 134 of FIG. 1. The reflector 200 can be made from any suitable process-compatible metal including, but not limited to, stainless steel, aluminum, or copper. The metal needs to be able to reflect (or block) microwave energy. The reflector 200 can have one or more geometrical configurations including, but not limited to, rectangular, oval, circular, octagon (or other polygon) etc. For example, in at least some embodiments, the reflector 200 can have a generally annular or circumferential configuration. More particularly, the reflector 200 can include a first portion 202 having an inner diameter (ID) of about 210 mm and an outer diameter ($OD_1$) of about 280 mm. The first portion 202 is defined by an inner edge 204 and an outer edge 206. An ID thickness $t_1$ of the first portion from the inner edge 204 to the outer edge 206 can be about 1.00 mm to about 5.00 mm (see cross-sectional side view in FIG. 2B). The ID thickness $t_1$ of the first portion should be thick enough to reduce or eliminate transmission of microwaves.

The reflector 200 also includes a second portion 208. The second portion 208 includes an $OD_2$ thickness $t_2$ of about 1.00 mm to about 5.00 mm, forming a step 208*a* from the outer edge 206 of the first portion 202 to an outer edge 210 of the second portion 208 (see FIG. 2B). The $OD_2$ (e.g., at the outer edge 210 of the second portion 208) is about 300 mm-350 mm. In at least some embodiments, however, the $OD_2$ can be less than 300 mm and greater than 350 mm, e.g., depending on the dimensions of the inner volume 106, the process chamber 102, a distance between waveguide opening 111 and the substrate 112, wavelength of microwave energy used, etc. The other dimensions of the reflector 200 (e.g., ID, $OD_1$) can also be scaled depending on, for example, the size of the substrate being processed, the dimensions of the inner volume 106, the process chamber 102, a distance between waveguide opening 111 and the substrate 112, wavelength of microwave energy used, etc.

The reflector 200 is coupled to the peripheral member 130*a* (see FIG. 1, for example). In at least some embodiments, for example, the reflector 200 can be fixedly or removably coupled to the peripheral member 130*a* via one or more coupling devices, e.g., clamps, locking devices, screws, nuts, bolts, or other suitable device(s). For example, in the latter embodiment, the reflector 200 can be coupled to the peripheral member 130*a* via a clamp so that the reflector 200 can be removed from the peripheral member 130*a* for routine maintenance.

Figure 3:
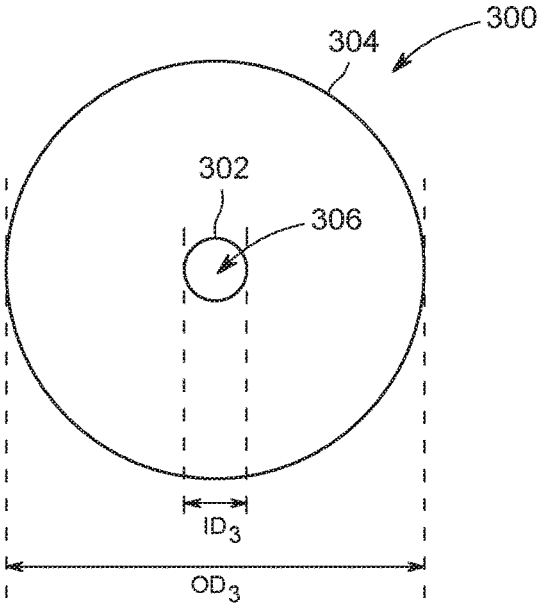
FIG. 3 is a schematic top view of a hardware component of the process chamber in accordance with at least some embodiments of the present disclosure.

FIG. 3 is a schematic top view of a microwave reflector 300 (reflector 300) of the process chamber in accordance with at least some embodiments of the present disclosure. The reflector 300 can be used as the second microwave reflector 136 of FIG. 1. The reflector 300 can be made from any suitable process-compatible metal including, but not limited to, stainless steel, aluminum, or copper. The reflector 300 can have any suitable geometrical configuration to pass and/or reflect microwaves when processing substrates as described herein. Examples of suitable geometric configurations include, but are not limited to, rectangular, oval, circular, octagon (or other polygon) etc. For example, in at least some embodiments, the reflector 300 can have a generally annular or circumferential configuration, similar to the reflector 200. Unlike the reflector 200, however, the reflector 300 includes an even thickness from an inner edge 302 to an outer edge 304. For example, in at least some embodiments, a thickness of the reflector 300 can be about 1.00 mm to 5.00 mm, e.g., thick enough to reduce or eliminate transmission of microwaves. The reflector 300 includes an $ID_3$ of about 45 mm to about 51 mm and an $OD_4$ of about 300 mm to about 350 mm, e.g., depending on the dimensions of the inner volume 106, the process chamber 102, a distance between waveguide opening 111 and the substrate 112, wavelength of microwave energy used, etc. The inner edge 302 defines an aperture 306 through which microwave energy can be transmitted through, as will be described in greater detail below.

Additionally, unlike the reflector 200 which is coupled to the peripheral member 130*a*, the reflector 300 is coupled to the hoop 128 (see FIG. 1, for example). In at least some embodiments, for example, the reflector 300 can be fixedly or removably coupled to the hoop 128 via one or more coupling devices, e.g., clamps, locking devices, screws, nuts, bolts, or other suitable device(s). For example, in the latter embodiment, the reflector 300 can be coupled to the hoop 128 via a clamp so that the reflector 300 can be removed from the hoop 128 for routine maintenance.

In an assembled configuration, the substrate 112, the reflector 200, and the reflector 300 can be spaced-apart from each other and/or the waveguide opening 111 of the waveguide 110 at any suitable distance. For example, the inventors have found that to ensure even/uniform heating of the substrate 112 a distance $d_1$ that a bottom surface of the reflector 200 can be from a top surface of the substrate 112 is at least three microwave wavelengths. Additionally, a distance $d_2$ that a bottom surface of the substrate 112 can be from the waveguide opening 111 or the bottom surface 107 (e.g., depending if the waveguide opening 111 is flush with the bottom surface 107) is at least three microwave wavelengths. In at least some embodiments, for example, the distance $d_2$ can be equal to about 160 mm. Moreover, a distance $d_3$ that a bottom surface of the reflector 300 can be from the waveguide opening 111 or the bottom surface 107

(e.g., again depending if the waveguide opening 111 is flush with the bottom surface 107) is about 15 mm to about 80 mm.

Figure 4:
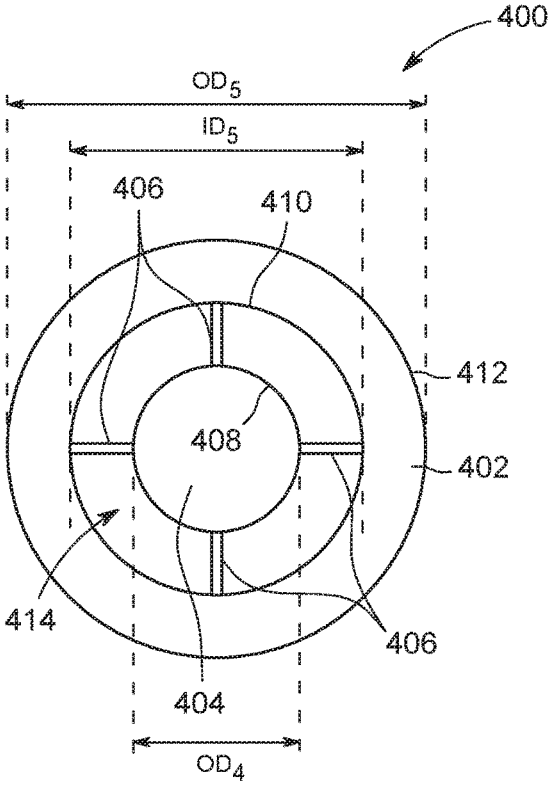
FIG. 4 is a schematic top view of a hardware component of the process chamber in accordance with at least some embodiments of the present disclosure.

FIG. 4 is a schematic top view of a microwave reflector (reflector 400) of the process chamber 102 in accordance with some embodiments of the present disclosure. The reflector 400 can be used as the optional third microwave reflector 138 of FIG. 1. The reflector 400 can have any suitable geometrical configuration as described above, including, but not limited to, rectangular, oval, circular, octagon (or other polygon) etc. For example, in at least some embodiments, the reflector 400 can have a generally annular or circumferential configuration, similar to the reflector 200. For example, the reflector 400 can include an annular first portion 402 and a circular second portion 404 (or center) that can be coupled to the first portion 402 via one or more coupling members. For example, in at least some embodiments, the first portion 402 can be coupled to the second portion 404 using two or more metal connectors 406 (e.g., metal rods or pins). For example, in the illustrated embodiment, four metal connectors 406 are shown coupling the second portion 404 to the first portion 402. The metal connectors 406 are configured to couple the first portion 402 to the second portion 404 and to support maintain the first portion 402 in a relatively fixed position relative to the second portion 404.

The second portion 404 includes an outer edge 408 that defines an $OD_4$ of the second portion 404 that can be about 1.00 mm to about 5.00 mm. The first portion 402 can have similar dimensions as the first portion 202 of the reflector 200. For example, in at least some embodiments, the first portion 402 can have an $ID_5$ (e.g., measured from a center of the second portion 404 to an inner edge 410 of the first portion 402) of about 210 mm and an $OD_5$ (e.g., measured from the center of the second portion 404 to an outer edge 412 of the first portion 402) of about 300 mm to 350 mm. A thickness of the first portion 402 and/or the second portion 404 can be equal to the thickness $t_1$ or the thickness $t_2$ of the first portion 202 or the second portion 208, respectively, e.g., a thickness of about 1.00 mm to 5.00 mm.

An opening 414 is formed between the outer edge 408 of the second portion 404 and the inner edge 410 of the first portion 402. The opening 414 is configured to allow microwave energy that is transmitted through the aperture 306 of the reflector 300 to pass therethrough for heating a bottom surface of the substrate 112.

The first portion 402, the second portion 404, and/or the metal connectors 406 of the reflector 400 can be made from any suitable metal including, but not limited to, copper, aluminum, stainless steel.

In the assembled configuration, similar to the reflector 200, the reflector 400 is coupled to one of the peripheral members, e.g., the peripheral member 130*c* (see FIG. 1, for example). In at least some embodiments, for example, the reflector 400 can be fixedly or removably coupled to the peripheral member 130*c* via one or more coupling devices, e.g., clamps, locking devices, screws, nuts, bolts, or other suitable device(s). For example, in the latter embodiment, the reflector 400 can be coupled to the peripheral member 130*c* so that the reflector 400 can be removed from the peripheral member 130*c* for routine maintenance.

Figure 5:
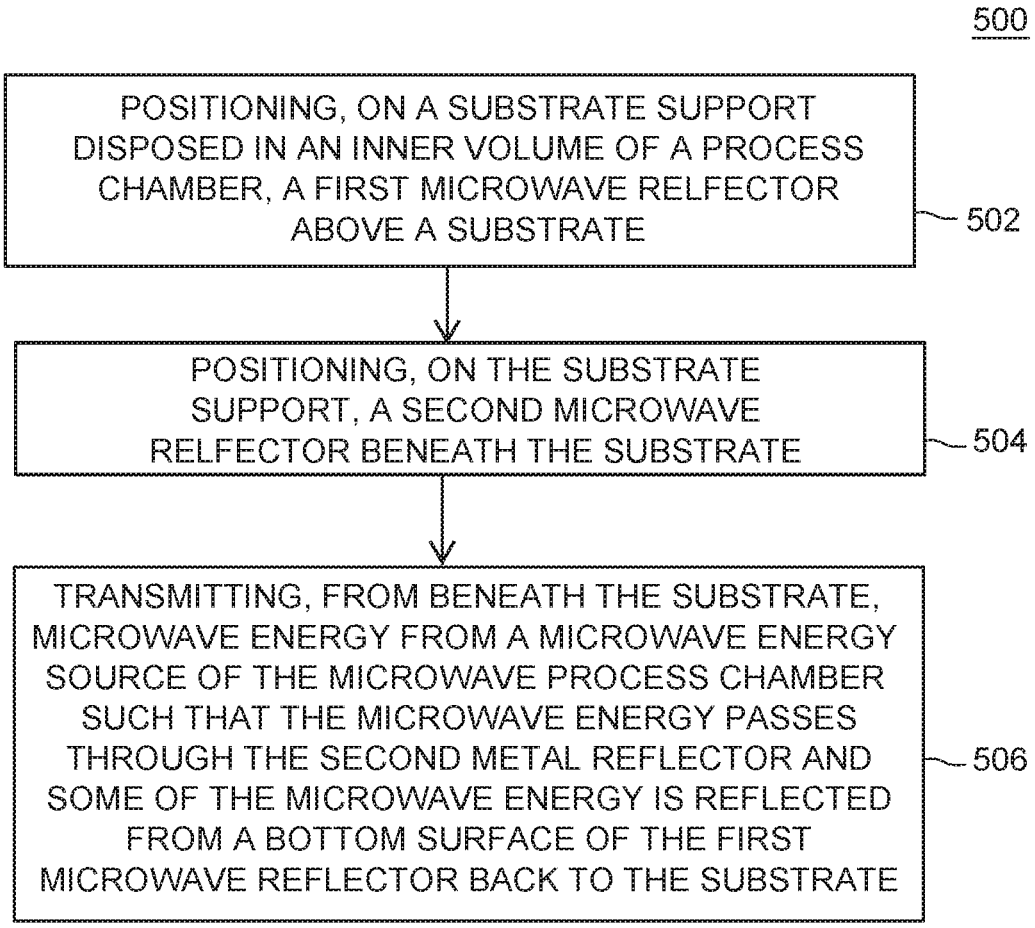
FIG. 5 is a flowchart of a method for processing a substrate in accordance with at least some embodiments of the present disclosure.

FIG. 5 is a flowchart of a method 500 for processing a substrate in accordance with some embodiments of the present disclosure. Initially, a substrate, e.g., the substrate 112, can be positioned on a peripheral member within an inner volume (e.g., the inner volume 106) of a process chamber (e.g., the process chamber 102). For example, the substrate can be positioned onto the peripheral member 130*b* of the substrate support 124. Additionally, in at least some embodiments, one type of process chamber that can be configured for use in accordance with the present disclosure can be, for example, the CHARGER®/ENDURA® Underbump Metallization line of PVD apparatus, available from Applied Materials Inc. of Santa Clara, Calif.

Next, at 502 a first microwave reflector (e.g., the reflector 200) can be provided and positioned above the substrate. For example, as noted above, the reflector 200 can be positioned on the peripheral member 130*a*. At 504, a second microwave reflector (e.g., the reflector 300) can be provided and positioned beneath the substrate. For example, the reflector 300 can be positioned on the hoop 128.

In some embodiments, the optional reflector 400 can be provided and positioned on the peripheral member 130*c*. The reflector 400 can be used to direct some of the microwave energy transmitted through the aperture 306 of the reflector 300.

Next, at 506, under the control of the controller 114, microwave energy is transmitted from the waveguide opening 111 (e.g., from beneath the substrate) and passes through the aperture 306 of the reflector 300. Additionally, some of the some of the microwave energy, e.g., the microwave energy that passes through the substrate, is reflected from a bottom surface, e.g., of the first portion 202 and the second portion 208, of the reflector 200 and back to the substrate during operation. The reflected microwave energy from the reflector 200 heats a top surface (e.g., areas of the substrate other than the edges) of the substrate and provides even/uniform heating of the substrate (e.g., reduce edge hot phenomenon). Additionally, the reflector 200 causes diffraction of some of the propagating microwave, which, in turn, provides a more predictive propagation pattern.

In at least some embodiments, such as when the optional reflector 400 is used, some of the microwave energy transmitted through the aperture 306 of the reflector 300 is also transmitted through the opening 414 between the first portion 402 and the second portion 404 of the reflector 400. Additionally, some of the microwave energy is reflected from bottom surfaces of the first portion 402 and the second portion 404 of the reflector 400 to the reflector 300. Some of the reflected microwave energy from the reflector 400 can then be redirected back from the reflector 300 and through the opening 414 between the first portion 402 and the second portion 404 of the reflector 400, thus providing additional uniform heating of the substrate. The reflector 400 also prevents direction microwave impingement, e.g., where the center of the substrate heats up too quickly.

While the foregoing is directed to embodiments of the present disclosure, other and further embodiments of the disclosure may be devised without departing from the basic scope thereof.

The invention claimed is:

1. A process chamber for processing a substrate, comprising:

a microwave energy source configured to provide microwave energy from beneath a substrate support provided in an inner volume of the process chamber;

a first microwave reflector positioned on the substrate support above a substrate supporting position of the substrate support; and a second microwave reflector positioned on the substrate support beneath the substrate supporting position; and a third microwave reflector having a generally annular configuration with a center second portion connected to an inner edge of a first portion via at least two metal connectors, wherein the first microwave reflector and the second microwave reflector are positioned and configured such that microwave energy passes through the second microwave reflector and some of the microwave energy is reflected from a bottom surface of the first microwave reflector back to the substrate during operation, and wherein the third microwave reflector is positioned such that microwave energy is reflected from bottom surfaces of the first portion and the second portion of the third microwave reflector to the second microwave reflector and redirected back from the second microwave reflector and to the substrate during operation.

2. The process chamber of claim 1, wherein the first microwave reflector includes an annular configuration having:

an inner diameter of about 100 mm to about 250 mm and an inner diameter thickness of about 1.00 mm to about 5.00 mm; and an outer diameter of about 300 mm to about 350 mm and an outer diameter thickness of about 1.00 mm to about 5.00 mm.

3. The process chamber of claim 1, wherein the first microwave reflector includes a first portion defined by an inner edge and an outer edge, and a step defined from the outer edge of the first portion to an outer edge of a second portion of the first microwave reflector.

4. The process chamber of claim 1, wherein the first microwave reflector is made from at least one of stainless steel, aluminum, or copper.

5. The process chamber of claim 1, wherein the second microwave reflector includes an annular configuration having:

an inner diameter of about 45 mm to about 51 mm; and an outer diameter of about 300 mm to about 350 mm.

6. The process chamber of claim 1, wherein the second microwave reflector is made from at least one of copper, aluminum, or stainless steel.

7. The process chamber of claim 1, wherein the third microwave reflector is positioned on the substrate support above the second microwave reflector and beneath the substrate supporting position.

8. The process chamber of claim 7, wherein the first portion, the center second portion, and the at least two metal connectors of the third microwave reflector are made from at least one of copper, aluminum, stainless steel.

9. The process chamber of claim 1, wherein a distance that the bottom surface of the first microwave reflector is from a top surface of the substrate is at least three microwave wavelengths, a distance that a bottom surface of the substrate is from one of a bottom surface disposed within the inner volume of the process chamber or a waveguide opening disposed at the bottom surface is at least three microwave wavelengths but no greater than about 160 mm, and a distance that a bottom surface of the second microwave reflector is from one of the bottom surface disposed within the inner volume of the process chamber or the waveguide opening is about 15 mm to about 80 mm.

10. The process chamber of claim 1, wherein the substrate is made from at least one of glass having at least one metal deposited thereon, silicon having at least one metal deposited thereon, or epoxy with embedded silicon dies.

11. A process chamber for processing a substrate, comprising:

a substrate support provided in an inner volume of the process chamber;

a first microwave reflector positioned on the substrate support above a substrate supporting position of the substrate support;

a second microwave reflector positioned on the substrate support beneath the substrate supporting position; and a third microwave reflector having a generally annular configuration with a center second portion connected to an inner edge of a first portion via at least two metal connectors, the third microwave reflector positioned on the substrate support above the second microwave reflector and beneath the substrate supporting position, wherein the microwave energy passes through the second microwave reflector and some of the microwave energy passes through the third microwave reflector such that some of the microwave energy is reflected from a bottom surface of the first microwave reflector back to the substrate during operation.

12. A method for processing a substrate using a process chamber, comprising:

positioning, on a substrate support disposed in an inner volume of the process chamber, a first microwave reflector above a substrate;

positioning, on the substrate support, a second microwave reflector beneath the substrate;

positioning, on the substrate support, a third microwave reflector having a generally annular configuration with a center second portion connected to an inner edge of a first portion via at least two metal connectors; and transmitting, from beneath the substrate, microwave energy from a microwave energy source of the process chamber such that the microwave energy passes through the second microwave reflector and some of the microwave energy passes through the third microwave reflector such that some of the microwave energy is reflected from a bottom surface of the first microwave reflector back to the substrate.

13. The method of claim 12, wherein providing the first microwave reflector comprises providing the first microwave reflector with annular configuration having:

an inner diameter of about 100 mm to about 250 mm and an inner diameter thickness of about 1.00 mm to about 5.00 mm; and an outer diameter of about 300 mm to about 350 mm and an outer diameter thickness of about 1.00 mm to about 5.00 mm.

14. The method of claim 12, wherein providing the first microwave reflector comprises providing the first microwave reflector with:

a first portion defined by an inner edge and an outer edge, and a step defined from the outer edge of the first portion to an outer edge of a second portion of the first microwave reflector.

15. The method of claim 12, wherein the first microwave reflector is made from at least one of stainless steel, aluminum, or copper.

16. The method of claim 12, wherein providing the second microwave reflector comprises providing the second microwave reflector with an annular configuration having:

an inner diameter of about 45 mm to about 51 mm; and an outer diameter of about 300 mm to about 350 mm.

17. The method of claim 12, wherein the second microwave reflector is made from at least one of copper, aluminum, or stainless steel.

18. The method of claim 12, wherein the third microwave reflector is positioned above the second microwave reflector and beneath the substrate supporting position.

19. The method of claim 18, wherein the first portion, the second portion, and the at least two metal connectors of the third microwave reflector are made from at least one of copper, aluminum, stainless steel.

20. The method of claim 12, wherein a distance that the bottom surface of the first microwave reflector is from a top surface of the substrate, when present, is at least three microwave wavelengths, a distance that a bottom surface of the substrate, when present, is from one of a bottom surface disposed within the inner volume of the process chamber or a waveguide opening disposed at the bottom surface is at least three microwave wavelengths but no greater than about 160 mm, and a distance that a bottom surface of the second microwave reflector is from one of the bottom surface disposed within the inner volume of the process chamber or the waveguide opening is about 15 mm to about 80 mm.

* * * * *